US012577644B2

(12) United States Patent
Gao et al.

(10) Patent No.: US 12,577,644 B2
(45) Date of Patent: Mar. 17, 2026

(54) METHODS FOR PRODUCING ALLOY TOOLS

(71) Applicants: ZENITH STEEL GROUP CO., LTD., Changzhou (CN); CHANGZHOU ZENITH SPECIAL STEEL CO., LTD., Changzhou (CN)

(72) Inventors: Xieqing Gao, Changzhou (CN); Ying Wang, Changzhou (CN); Zhenwei Su, Changzhou (CN); Xianghong Wang, Changzhou (CN); Xinyu Zhao, Changzhou (CN); Jian Han, Changzhou (CN); Miao Zhou, Changzhou (CN); Huicheng Li, Changzhou (CN)

(73) Assignees: ZENITH STEEL GROUP CO., LTD., Changzhou (CN); CHANGZHOU ZENITH SPECIAL STEEL CO., LTD., Changzhou (CN)

( * ) Notice: Subject to any disclaimer, the term of this patent is extended or adjusted under 35 U.S.C. 154(b) by 0 days.

(21) Appl. No.: 19/270,504

(22) Filed: Jul. 16, 2025

(65) Prior Publication Data

US 2026/0015700 A1 Jan. 15, 2026

Related U.S. Application Data

(63) Continuation of application No. PCT/CN2024/112301, filed on Aug. 15, 2024.

(30) Foreign Application Priority Data

Jul. 12, 2024 (CN) ..... 202410936405.X

(51) Int. Cl.
*C22C 38/34* (2006.01)
*C22C 38/00* (2006.01)
(Continued)

(52) U.S. Cl.
CPC ..... *C22C 38/34* (2013.01); *C22C 38/002* (2013.01); *C22C 38/02* (2013.01); *C22C 38/04* (2013.01);
(Continued)

(58) Field of Classification Search
CPC ..... B25B 15/002; C21D 1/18; C21D 1/32; C21D 2211/008; C21D 6/004;
(Continued)

(56) References Cited

U.S. PATENT DOCUMENTS

2025/0010434 A1* 1/2025 Jang ..... C22C 38/34

FOREIGN PATENT DOCUMENTS

CN 101389772 A 3/2009
CN 114318125 A 4/2022
(Continued)

OTHER PUBLICATIONS

NPL: on-line translation of JP 2002097551 A, Apr. 2002 (Year: 2002).*

(Continued)

*Primary Examiner* — Jie Yang
(74) *Attorney, Agent, or Firm* — PORUS IP LLC

(57) ABSTRACT

The present disclosure belongs to the field of steel materials, and relates to a steel wire rod for producing alloy tools with high fatigue life and high impact resistance and an application thereof. Chemical compositions of the steel include, by weight percentage: [C] 0.83%-0.92%, [Si] 2.30%-2.60%, [Mn] 0.40%-0.80%, [Cr] 0.70%-1.05%, [Ni] 1.31%-1.61%, [V] 0.14%-0.30%, [Al] 0.025%-0.060%, [P]≤0.025%, [S]≤0.020%, with the rest being Fe and unavoidable impurities. The alloy tool steel wire rod obtained in the present disclosure is suitable for producing screwdriver bits, screwdrivers, hex wrenches, etc., requiring high fatigue life and high impact resistance, and has the following properties:
(Continued)

hardness within a range of 60-62 HRC, fatigue life of not less than 30,000 cycles, and impact resistance of not less than 60 seconds.

2 Claims, 3 Drawing Sheets

(51) Int. Cl.
*C22C 38/02* (2006.01)
*C22C 38/04* (2006.01)
*C22C 38/06* (2006.01)
*C22C 38/46* (2006.01)

(52) U.S. Cl.
CPC ..... *C22C 38/06* (2013.01); *C22C 38/46* (2013.01); *C22C 2202/02* (2013.01)

(58) Field of Classification Search
CPC .... C21D 6/005; C21D 6/008; C22C 2202/02; C22C 38/001; C22C 38/002; C22C 38/02; C22C 38/04; C22C 38/06; C22C 38/34; C22C 38/42; C22C 38/44; C22C 38/46; C22C 38/48
See application file for complete search history.

(56) References Cited

FOREIGN PATENT DOCUMENTS

| | | | | | |
|---|---|---|---|---|---|
| CN | 115430706 | A | * | 12/2022 | ..... B21B 27/08 |
| CN | 116970868 | A | | 10/2023 | |
| FR | 2916371 | A1 | * | 11/2008 | ..... C21D 6/004 |
| JP | 2002097551 | A | * | 4/2002 | |
| JP | 2002275584 | A | | 9/2002 | |
| JP | 2003105485 | A | | 4/2003 | |

OTHER PUBLICATIONS

NPL: on-line translation of FR-2916371-A1, Nov. 2008 (Year: 2008).*
NPL: on-line translation of CN-115430706-A, Dec. 2022 (Year: 2022).*
International Search Report in PCT/CN2024/112301 mailed on Dec. 13, 2024, 6 pages.
Written Opinion in PCT/CN2024/112301 mailed on Dec. 13, 2024, 5 pages.

* cited by examiner

METHODS FOR PRODUCING ALLOY TOOLS

CROSS-REFERENCE TO RELATED APPLICATIONS

This application is a Continuation of International Application No. PCT/CN2024/112301, filed on Aug. 15, 2024, which claims priority to Chinese Patent Application No. 202410936405. X, filed on Jul. 12, 2024, the entire contents of each of which are hereby incorporated by reference.

TECHNICAL FIELD

The present disclosure relates to the field of steel material manufacturing, and in particular, to a steel wire rod for producing alloy tools with high fatigue life and high impact resistance and an application thereof.

BACKGROUND

In modern industry, a screw fastening system is mechanical equipment specifically designed for semi-automatic or fully automatic screw driving, consisting of a screwdriver bit (a screwdriver, a hex wrench, etc.) combined with electric or pneumatic tools to form a complete system. Components in direct contact with screws include the screwdriver bit, a driver bit, the screwdriver, etc., which need to have high hardness, high torque, high impact resistance, and high fatigue life. They are wear-prone consumables and need to be replaced after a certain period of use.

A highest-grade material of screwdriver bit commonly used in the industry is S2M. Its chemical compositions include, by weight percentage: [C] 0.66%-0.72%, [Si] 0.85%-1.10%, [Mn] 0.40%-0.55%, [Cr] 0.15%-0.30%, [Ni] 0.10%-0.20%, [Mo] 0.38%-0.45%, [V] 0.15%-0.25%. Taking the widely used T25*57 mm finished screwdriver bit as an example, conventional heat treatment (full martensite quenching followed by tempering) yields a tool hardness of 58-60 HRC, though no fatigue life or impact resistance data are available for this process.

Application CN202310995781.1 discloses a high-strength and high-wear-resistance alloy tool steel and a smelting method thereof, which provides its chemical compositions, by weight percentage: [C] 0.70%-0.76%, [Si] 1.40%-1.60%, [Mn] 0.50%-0.80%, [Cr] 1.00%-1.20%, [Ni] 0.20%-0.26%, [V] 0.14%-0.20%, [Al] 0.020%-0.040%, [P]≤0.025%, [S]≤0.020%, with the rest being Fe and unavoidable impurities. This smelting method is essentially a spring steel design approach by improving a carbon content and adding some Ni to 60Si2CrV and is a different steel grade system from S2M. This application does not disclose the heat treatment and final product performance; the invention is incomplete and lacks comparability. Application CN202011060372.5 discloses a high-strength and high-toughness alloy tool steel wire rod and a manufacturing method thereof, which provides its chemical compositions including: [C] 0.60 wt. %-0.90 wt. %, [Si] 1.00 wt. %-3.00 wt. %, [Mn] 0.45 wt. %-1.00 wt. %, [Cr] 0.45 wt. %-1.00 wt. %, [Mo] 0.20 wt. %-0.60 wt. %. After the steel is subjected to the above conventional heat treatment, its Rockwell hardness is 58HRC-62HRC, and the torsion angle per unit length is 10°/mm-15°/mm, which is considered to indicate excellent resistance to torsional fracture. However, the torsion angle per unit length describes the high-strength and high-toughness alloy tool steel wire rod itself, not tools made from it. In fact, the torsion (fracture) angle is highly related to the structural design of the tool. Moreover, resistance to torsional fracture is also related to torsional strength and impact resistance. Data of a single torsion (fracture) angle cannot fully illustrate the problem, especially for automatic machines where the impact resistance is crucial. Overall, this application does not mention the fatigue life and the impact resistance of the material, lacking comparability. Additionally, the composition range of steel in this application is too broad; the performance differences among various composition combinations would be significant, and some combinations may not achieve the performance described in the application. Traditional alloy tool steel S2M contains about 0.4% [Mo]. The [Mo] element significantly increases hardenability and hardness, making it easy for hot-rolled wire rod structures to form martensite and other abnormal structures leading to brittle fracture, and it is also expensive. Most traditional alloy tool steels have no requirements for the fatigue life and the impact resistance; even if the fatigue life is specified, it does not exceed 10,000 cycles, and no documented standards exist for impact resistance. The high fatigue life and the high impact resistance are required to meet the needs of machines operating with minimal or no downtime in the Industry 4.0 era.

After industrial automation entered the new Industry 4.0 era, there is a need to further improve work efficiency. The screw fastening system needs to operate for long time periods with minimal or no downtime. Simultaneously, the application scope of high-strength screws is constantly expanding. Therefore, the service life of tools such as screwdriver bits urgently needs further improvement, requiring a qualitative enhancement in properties such as hardness, impact resistance, and fatigue life.

SUMMARY

Aiming at the deficiencies of the prior art, a purpose of the present disclosure is to provide a steel wire rod for producing alloy tools with high fatigue life and high impact resistance and an application thereof. The alloy tool steel wire rod obtained in the present disclosure through composition design, after undergoing spheroidizing annealing process to produce tools such as screwdriver bits, is then subjected to bainite isothermal quenching and tempering treatment. The final tempered screwdriver bits, screwdrivers, hex wrenches, etc., meet the requirements of high fatigue life and high impact resistance, having the following properties: hardness within a range of 60-62 HRC, fatigue life in fatigue tests not less than 30,000 cycles, and impact resistance not less than 60 seconds.

To achieve the above purpose, the present disclosure provides the following technical solution.

One or more embodiments of the present disclosure provide a steel wire rod for producing alloy tools with high fatigue life and high impact resistance. The composition of high-carbon, high-silicon, nickel-enriched alloy tool steel is designed based on the principle of bainite isothermal quenching and tempering process. Chemical compositions of the steel wire rod comprise, by weight percentage: [C] 0.83%-0.92%, [Si] 2.30%-2.60%, [Mn] 0.40%-0.80%, [Cr] 0.70%-1.05%, [Ni] 1.31%-1.61%, [V] 0.14%-0.30%, [A1] 0.025%-0.060%, [P]≤0.025%, [S]≤0.020%, with the rest being Fe and unavoidable impurities.

One or more embodiments of the present disclosure provide a steel wire rod, wherein the chemical compositions of the steel wire rod comprise, by weight percentage: [C] 0.86%-0.90%, [Si] 2.31%-2.45%, [Mn] 0.40%-0.60%, [Cr] 0.75%-0.95%, [Ni] 1.31%-1.41%, [V] 0.18%-0.24%, [Al]

0.025%-0.050%, [P]≤0.025%, [S]≤0.015%, with the rest being Fe and unavoidable impurities.

BRIEF DESCRIPTION OF THE DRAWINGS

The present disclosure will be further illustrated by way of exemplary embodiments, which will be described in detail by means of the accompanying drawings. These embodiments are not limiting, and in these embodiments, the same numbering denotes the same structure, wherein:

FIG. 1-2 is a metallographic structure diagram of a screwdriver bit in Example 1;

FIG. 2-1 is a schematic diagram illustrating an appearance of a shank of a T25*57 mm finished screwdriver bit fractured in an impact resistance test.

FIG. 2-2 is a schematic diagram illustrating an appearance of a head of a T25*57 mm finished screwdriver bit fractured in an impact resistance test;

DETAILED DESCRIPTION

Figure 1:
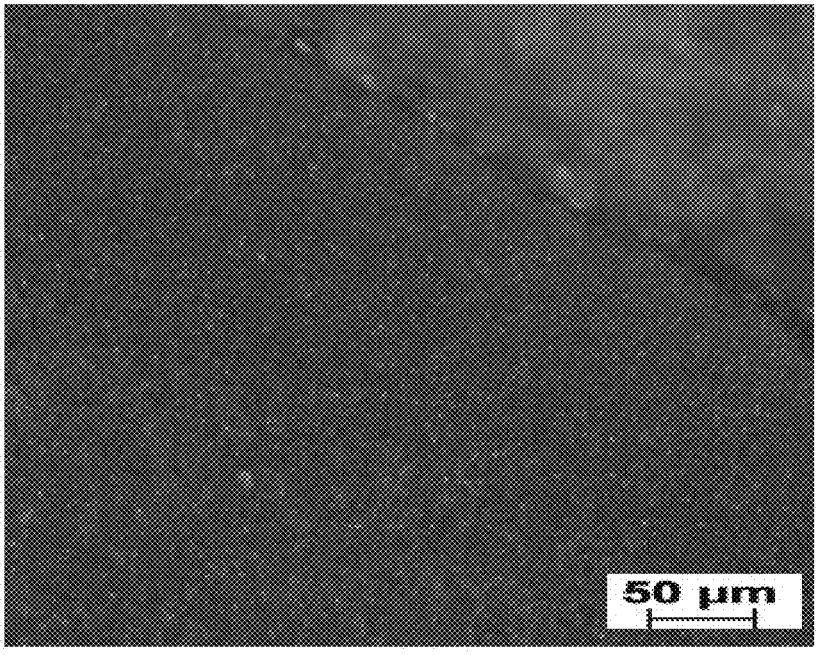
FIG. 1-1 is a decarburization layer diagram of a screwdriver bit in Example 1.

The accompanying drawings, which are required to be used in the description of the embodiments, are briefly described below. The accompanying drawings do not represent the entirety of the embodiments. When describing processes performed in the embodiments of the present disclosure in terms of operations, the order of the operations is all interchangeable, some operations may be omitted, and other operations may be included in the processes, if not otherwise specified.

A steel wire rod is a steel raw material in coil form, which may be used to produce alloy tools with high fatigue life and high impact resistance.

A material produced by the present disclosure are used to manufacture a product such as a screwdriver bit, a screwdriver, a hex wrench, etc., which has extremely strict requirements for final hardness, torque, torsion angle, fatigue life, and impact resistance. Composition is a key factor affecting final performance of the product. In a design of chemical compositions, a particular property is not only primarily affected by one element but also simultaneously influenced by a plurality of elements. Therefore, a rational design of the plurality of elements is required based on an intended use of the product.

To achieve the above objectives, a technical solution adopted by the present disclosure is as follows.

The present disclosure provides a steel wire rod for producing alloy tools with high fatigue life and high impact resistance. Combining a process principle of bainite isothermal quenching and tempering, it designs compositions of a high-carbon, high-silicon, nickel-rich alloy tool steel. The chemical compositions of the steel wire rod include, by weight percentage: [C] 0.83%-0.92%, [Si] 2.30%-2.60%, [Mn] 0.40%-0.80%, [Cr] 0.70%-1.05%, [Ni] 1.31%-1.61%, [V] 0.14%-0.30%, [Al] 0.025%-0.060%, [P]≤0.025%, [S]≤0.020%, with the rest being Fe and unavoidable impurities.

The present disclosure provides a steel wire rod for producing alloy tools with high fatigue life and high impact resistance. The chemical compositions of the steel wire rod include, by weight percentage: [C] 0.86%-0.90%, [Si] 2.31%-2.45%, [Mn] 0.40%-0.60%, [Cr] 0.75%-0.95%, [Ni] 1.31%-1.41%, [V] 0.18%-0.24%, [A1] 0.025%-0.050%, [P]≤0.025%, [S]≤0.015%, with the rest being Fe and unavoidable impurities.

A reason for the composition design in the present disclosure is as follows.

[C] is a most effective element in steel for increasing strength and hardness, with significant solid solution strengthening effect. A low carbon content results in low steel hardness and poor wear resistance, but an excessively high content may form massive carbides. Additionally, in the steel of the present disclosure, carbon also acts to lower Bainite Start Temperature (Bs). Bainite isothermal transformation occurs below a nose point of a bainite transformation curve. A lower Bs temperature leads to better overall properties. However, an excessively high carbon content makes bainite nucleation difficult, increases an incubation period, and decreases a bainite transformation rate. Therefore, there is a contradiction between the low Bs temperature and a high bainite transformation rate, meaning carbon needs to have an appropriate content.

In some embodiments, the [C] content may be in a range of 0.83%-0.92%.

In some embodiments, the [C] content may also be one of 0.83%, 0.84%, 0.85%, 0.86%, 0.87%, 0.88%, 0.89%, 0.90%, 0.91%, or 0.92%.

In some embodiments, the [C] content may also be in one of 0.86%-0.90%, 0.83%-0.92%, 0.83%-0.91%, 0.84%-0.92%, 0.83%-0.90%, 0.85%-0.92%, 0.84%-0.91%, 0.86%-0.92%, 0.83%-0.89%, 0.84%-0.90%, 0.85%-0.91%, 0.87%-0.92%, 0.83%-0.88%, 0.86%-0.91%, 0.84%-0.89%, or 0.85%-0.90%.

[Si] can significantly increase an elastic limit, a yield point, and a strength of steel. Adding a certain amount of silicon to quenched and tempered steel, combined with elements like chromium and molybdenum, can improve properties such as oxidation resistance, corrosion resistance, and heat resistance. Silicon also serves as a common deoxidizer, partially replacing aluminum for deoxidation. Additionally, in the steel of the present disclosure, silicon also acts to inhibit a formation of cementite during cooling and hinder a decomposition of [C] in undercooled austenite. However, a high silicon content may also lead to a formation of a hard oxide layer on a steel surface, reducing coating ability. Simultaneously, a strengthening effect of the [Si] element is significant and an excessively high content may cause brittleness of the steel to increase.

In some embodiments, the [Si] content may be in a range of 2.30%-2.60%.

In some embodiments, the [Si] content may also be one of 2.30%, 2.31%, 2.35%, 2.38%, 2.40%, 2.45%, 2.48%, 2.50%, 2.55%, or 2.60%.

In some embodiments, the [Si] content may also be in one of 2.31%-2.45%, 2.31%-2.60%, 2.30%-2.55%, 2.35%-2.60%, 2.31%-2.55%, 2.38%-2.60%, 2.30%-2.50%, 2.40%-2.60%, 2.31%-2.50%, 2.30%-2.48%, 2.31%-2.48%, 2.30%-2.45%, 2.45%-2.60%, or 2.35%-2.48%.

[Mn] can increase the strength of the steel, weaken and eliminate adverse effects of sulfur, significantly improve the hardenability of the steel, and enhance its hot workability. As an austenite-forming element, [Mn] may lower a temperature at which cementite begins to precipitate. However, an excessively high [Mn] content is detrimental, as it may lead to banding in the microstructure.

In some embodiments, the [Mn] content may be in a range of 0.40%-0.80%.

In some embodiments, the [Mn] content may also be one of 0.40%, 0.45%, 0.49%, 0.5%, 0.51%, 0.53%, 0.55%, 0.60%, 0.7%, or 0.8%.

In some embodiments, the [Mn] content may also be in one of 0.40%-0.60%, 0.40%-0.80%, 0.45%-0.80%, 0.49%-0.80%, 0.5%-0.80%, 0.51%-0.80%, 0.53%-0.80%, 0.55%-0.80%, 0.60%-0.80%, 0.40%-0.7%, 0.45%-0.7%, 0.49%-0.7%, 0.5%-0.7%, 0.51%-0.7%, 0.53%-0.7%, 0.40%-0.55%, 0.45%-0.60%, 0.40%-0.53%, 0.40%-0.51%, 0.49%-0.60%, 0.40%-0.5%, 0.45%-0.55%, 0.5%-0.60%, or 0.51%-0.60%.

[Cr] is one of fundamental elements in wear-resistant materials, significantly increasing the strength, the hardness, and the wear resistance of the steel, while also improving the steel's oxidation and corrosion resistance. Alloy tool steels generally contain about 0.20% [Cr]. The present disclosure aims to enhance the wear resistance.

In some embodiments, the [Cr] content may be in a range of 0.70%-1.05%.

In some embodiments, the [Cr] content may also be one of 0.70%, 0.72%, 0.79%, 0.80%, 0.81%, 0.83%, 0.85%, 0.90%, 0.95%, 1.00%, or 1.05%.

In some embodiments, the [Cr] content may also be in one of 0.75%-0.95%, 0.72%-0.75%, 0.79%-0.80%, 0.80%-0.81%, 0.81%-0.83%, 0.83%-0.85%, 0.85%-0.90%, 0.90%-0.95%, 0.95%-1.00%, 0.80%-1.05%, 0.75%-0.83%, 0.79%-1.00%, 0.80%-0.90%, or 0.85%-0.95%.

[Ni] expands an austenite phase region, forms an infinite solid solution, does not form carbides, increases the strength of the steel, acts as a solid solution strengthener, and improves hardenability, while also enhancing the steel's corrosion resistance. In low-alloy steels, nickel primarily serves to increase plasticity and toughness. Nickel is a relatively scarce resource.

In some embodiments, the [Ni] content may be in a range of 1.31%-1.61%.

In some embodiments, the [Ni] content may also be one of 1.31%, 1.32%, 1.33%, 1.34%, 1.35%, 1.36%, 1.37%, 1.41%, 1.50%, 1.60%, or 1.61%.

In some embodiments, the [Ni] content may also be in one of 1.31%-1.41%, 1.31%-1.32%, 1.32%-1.33%, 1.33%-1.34%, 1.34%-1.35%, 1.35%-1.36%, 1.36%-1.37%, 1.37%-1.41%, 1.41%-1.50%, 1.50%-1.60%, 1.60%-1.61%, 1.37%-1.60%, 1.50%-1.61%, 1.34%-1.41%, 1.32%-1.37%, or 1.31%-1.35%.

[V] can refine microstructure grains, increase strength and toughness, form the carbides with carbon, and improve hydrogen corrosion resistance under a high temperature and pressure. The alloy tool steels generally contain about 0.20% [V].

In some embodiments, the [V] content may be in a range of 0.14%-0.30%.

In some embodiments, the [V] content may also be one of 0.14%, 0.15%, 0.16%, 0.19%, 0.20%, 0.22%, 0.24%, 0.26%, 0.28%, or 0.30%.

In some embodiments, the [V] content may also be in one of 0.18%-0.24%, 0.14%-0.19%, 0.14%-0.20%, 0.14%-0.22%, 0.14%-0.24%, 0.14%-0.26%, 0.14%-0.28%, 0.14%-0.30%, 0.15%-0.19%, 0.18%-0.28%, 0.15%-0.22%, 0.15%-0.24%, 0.15%-0.26%, 0.15%-0.28%, or 0.18%-0.30%.

[Mo] significantly increases hardenability and hardness. A microstructure of hot-rolled wire rods is prone to forming abnormal structures such as martensite, leading to brittle fracture, and its price is high. If [Mo] is added in the present disclosure, it may constitute another steel grade system. Under a premise of high [C], high [Si], and high [Ni] in the present disclosure, adding the [Mo] element may multiply a risk of brittle fracture in the hot-rolled wire rods, potentially making normal production impossible. Therefore, the [Mo] element is not added in the present disclosure.

[Al] serves as a key deoxidizing element, simultaneously refines grains, and improves impact toughness. Aluminum also possesses oxidation and corrosion resistance capabilities. When used in combination with chromium and silicon, it can significantly enhance the steel's high-temperature scaling resistance and high-temperature corrosion resistance. Additionally, [Al] is insoluble in the cementite, greatly delaying the formation of cementite. Therefore, in the steel of the present disclosure, aluminum not only increases a formation temperature of cementite but also accelerates a formation of bainite. Hence, the aluminum content needs to be appropriately controlled.

In some embodiments, the [Al] content may be in a range of 0.025%-0.060%.

In some embodiments, the [Al] content may also be one of 0.025%, 0.028%, 0.032%, 0.035%, 0.039%, 0.041%, 0.042%, 0.045%, 0.050%, 0.052%, or 0.055%.

In some embodiments, the [Al] content may also be in one of 0.025%-0.050%, 0.025%-0.039%, 0.025%-0.041%, 0.025%-0.042%, 0.025%-0.045%, 0.025%-0.050%, 0.025%-0.052%, 0.025%-0.055%, 0.028%-0.042%, 0.028%-0.045%, 0.028%-0.050%, 0.028%-0.052%, 0.028%-0.055%, 0.032%-0.045%, 0.032%-0.050%, or 0.032%-0.052%.

[P] and [S] are generally harmful elements in the steel.

The preferred range in the present disclosure may be corrected to: [P]≤0.025% and [S]≤0.015%.

Regarding the steel wire rod for alloy tools with the high fatigue life and the high impact resistance, the present disclosure also provides a production process thereof, including converter smelting, LF refining, RH vacuum treatment, bloom continuous casting, high-temperature diffusion roughing, rolled billet finishing, billet heating, wire rod rolling, wire rod controlled cooling, etc. The specific operations are as follows:

(1) Converter Smelting

The converter smelting is a primary refining operation carried out under an oxidizing atmosphere for melting, dephosphorization, decarburization, and alloying the charge. The converter smelting may provide molten steel for subsequent refining.

In some embodiments, a converter is charged with a weight ratio of 80~85% hot metal and 15~20% scrap steel. High-carbon tapping operation is adopted at an end of smelting, achieving tap [C]>0.07%, tap [P]<0.015%, a tapping time of 4-6 min, and a tapping temperature>1600° C. Starting 30 seconds after tapping begins, aluminum cake, alloys (such as silicomanganese, ferrosilicon, ferrovanadium, high-carbon ferrochrome, ferronickel), ordinary recarburizer balls are added sequentially, slagging materials (lime and furnace lining protection agent) sequentially are added during tapping. Double slag blocking using a slide gate and a slag stopper is employed at the end of tapping. The molten steel is then lifted to a ladle furnace (LF) for refining.

(2) LF Refining

The LF is refining equipment that enables the molten steel to achieve deoxidation, desulfurization, alloying, etc., in a short time, realizing a preliminary refining of the molten steel.

In some embodiments, sampling is done before the LF refining station entry. In an early refining stage, calcium carbide, silicon carbide, or aluminum granules are used for deoxidation and desulfurization. Appropriate amounts of lime and fluorspar (cryolite) are added in batches based on slag fluidity. In the early refining stage, an appropriate amount of aluminum wire may be fed to supplement based on the [Al] content of the molten steel; feeding is allowed only once to ensure a target aluminum content in the final product. In mid and late stages, the silicon carbide is used for slag maintenance, i.e., adding the silicon carbide in small amounts and uniformly onto the slag surface to ensure a reducing atmosphere. In the mid-stage, other alloy compositions are adjusted to a target value based on a LF entry sample, aiming for target composition control while minimizing composition fluctuations, and the temperature is adjusted accordingly. Casting start temperature for a first heat: 1559° C.-1599° C., continuous casting temperature: 1529° C.-1569° C. Small argon stirring is used throughout a refining process.

(3) RH Vacuum Treatment

RH vacuum circulation degassing refining process (hereinafter referred to as RH) is a molten steel refining manner. The RH process removes gases from the molten steel and performs impurity removal treatments under vacuum conditions to eliminate harmful elements in the molten steel, achieving complete refining.

In some embodiments, after the molten steel arrives at a RH station, a ladle is raised to a vacuum tank, and cyclic vacuum pumping begins. A lift gas flow rate is controlled in a range of 80-120 $Nm^3/h$. A vacuum degree is reduced below 133 Pa and maintained for 20 minutes before break vacuum, followed by a modification treatment through feeding 100-300 meters of calcium wire. After soft blowing for 20-40 minutes, the molten steel is lifted to continuous casting for pouring. Casting start temperature control for the first heat: 1504° C.-1534° C., continuous casting temperature control: 1479° C.-1509° C.

(4) Bloom Continuous Casting

The bloom continuous casting is an operation of continuously pouring refined molten steel into cast billets. The bloom continuous casting may cast the molten steel into a required shape for subsequent processing.

In some embodiments, prior to continuous casting startup, a baking temperature of a tundish is above 1100° C., followed by 3-5 minutes of argon purging after stopping baking. After casting starts, the surface of the molten steel in the tundish is entirely protected throughout casting using monolithic nozzles with a superheat control of 20-30° C. At an end of each heat casting, slag is retained in the ladle. A casting speed is controlled at 0.80 m/min. Primary cooling water return temperature difference is controlled at 4-6° C. Secondary cooling specific water volume is 0.20 L/kg. Mold electromagnetic stirring (M-EMS, operating at 290-310 A with 300 A target current and 1.8-2.2 Hz with 2.0 Hz target frequency) and final electromagnetic stirring (F-EMS, operating at 290-310 A with 300 A target current and 5.8-6.2 Hz with 6.0 Hz target frequency) are implemented. Blooms are subjected to pit slow cooling with an entry temperature exceeding 500° C. and a holding time over 48 hours before removal from a pit.

(5) Roughing Production

The roughing production refers to a production operation of pre-processing the cast billet. The roughing production may include steps such as high-temperature diffusion and rolling. High-temperature diffusion may homogenize an internal composition of the cast billet, eliminating defects such as segregation. Rolling may process the cast billet into smaller-sized rolled billets, facilitating subsequent production and processing.

In some embodiments, 300 mm×325 mm cast billets undergo long-time high-temperature diffusion in a heating furnace with a total length of 51 m and a heating temperature within a range of 1220-1270° C. After long-time high-temperature diffusion, the cast billets are rough rolled through 10 stands into 160 mm×160 mm rolled billets. A collection temperature of the rolled billet is within a range of 400° C.-500° C. After rolling, the rolled billets are stacked for wind-sheltered cooling.

(6) Rolled Billet Finishing

The rolled billet finishing refers to an operation of pre-processing the rolled billets. The rolled billet finishing may include steps such as surface cleaning and inspection. The surface cleaning refers to removing dirt and defects from a surface of the rolled billet through manners like peeling or grinding wheel grinding; The inspection refers to a step of detecting whether the surface of the rolled billet is clean and defect-free.

In some embodiments, the 160 mm×160 mm rolled billets undergo finishing peeling with a single-side peeling depth of 2 mm, followed by surface inspection.

(7) Billet Heating

The billet heating refers to an operation of heating finished rolled billets. Heating brings the rolled billet to a temperature required for rolling.

In some embodiments, 156 mm×156 mm rolled billets are heated in a high-speed wire rod heating furnace. The heating temperature is within a range of 1150-1200° C., a heating time is within a range of 100-150 minutes, a rolling start temperature is within a range of 1050-1100° C.

(8) Wire Rod Rolling

The wire rod rolling refers to a production operation where the rolled billet is subjected to a plurality of times of rolling and coiled to obtain the steel wire rod.

In some embodiments, the rolled billet is processed through roughing, intermediate rolling, pre-finishing, and finishing rolling into a wire rod, which then enters a laying head. The finishing rolling temperature is within a range of 900-950° C., and the exit temperature from a finishing mill is not lower than 970° C.

(9) Wire Rod Controlled Cooling

The wire rod controlled cooling refers to a production operation of cooling down a high-temperature steel wire rod. The wire rod controlled cooling may be single-stage or multi-stage cooling. By setting a plurality of cooling temperatures, gradient cooling of the steel wire rod may be achieved. The cooling temperatures may be determined based on actual application scenarios and requirements.

In some embodiments, a laying head temperature of the wire rod is within a range of 900-940° C., followed by controlled cooling including rapid cooling in an initial stage and hood cooling in a subsequent stage. A hood entry temperature is within a range of 550-600° C. A hood exit temperature is below 490° C.

(10) Wire Rod Coiling, Bundling, Packing, and Warehousing

Subsequent heat treatment operations for the wire rod are as follows.

The wire rod needs to undergo spheroidizing annealing and pickling-drawing at a fine wire plant to be converted into hexagonal wire bars. An annealing process is 765° C.*12 h. A purpose of annealing is to facilitate subsequent drawing and machining.

After the wire rod is converted into the hexagonal wire bars, machining is performed to make the tools such as the screwdriver bit, the screwdriver, and the hex wrench. These tools are then subjected to the bainite isothermal quenching and the tempering treatment. An austenitizing temperature is within a range of 900-910° C. and the heating time is within a range of 80-90 minutes. A salt bath quenching temperature is within a range of 300-310° C. (a quenching medium is salt), an isothermal time is within a range of 55-65 minutes, a tempering temperature is within a range of 280-290° C., and a tempering time is within a range of 55~65 minutes.

A quenching temperature for the bainite isothermal quenching is below the nose point of the bainite transformation curve. The lower the Bs point, the lower the nose point, and the better the overall performance. To lower Bs, the carbon content needs to be significantly increased. However, the excessively high carbon content leads to too much cementite during quenching, which greatly impacts the fatigue life and the impact resistance. Therefore, the [Si] content needs to be increased. Silicon acts to inhibit the formation of cementite during cooling, forming lower bainite with good strength-toughness matching. Simultaneously, a high [Ni] content helps the material achieve better toughness. Service conditions for the tools like the screwdriver bit, the screwdriver, and the hex wrench necessitate the tempering treatment after the bainite isothermal quenching. A tempering process can release residual stress in the steel and improve its toughness. Therefore, by increasing the [C], [Si], and [Ni] contents in the steel wire rod, the present disclosure effectively lowers the Bs temperature of the material.

Compared with the prior art, beneficial effects of the present disclosure include: lowering the Bs temperature of the material through rational composition design. After the bainite isothermal quenching below the nose point of the bainite transformation curve and subsequent tempering, the screwdriver bit, the screwdriver, and the hex wrench made from the material of the present disclosure meet the requirements of the high fatigue life and the high impact resistance, i.e., they exhibit the following properties: the hardness within a range of 60-62 HRC, the fatigue life not less than 30,000 cycles, and the impact resistance not less than 60 seconds.

The present disclosure is further detailed below in conjunction with examples of the steel wire rod for alloy tools with high fatigue life and high impact resistance. Conditions not specified are conventional conditions. A finished T25*57 mm screwdriver bit is only an example; other tools with different head types and lengths, such as the screwdriver bits, the screwdrivers, the hex wrenches, etc., exhibit equivalent performance and can achieve excellent hardness, fatigue life, and impact resistance.

Example 1

(1) Converter Smelting

The converter was charged with a weight ratio of 102 tons of hot metal to 27 tons of scrap steel. The hot metal contained [Si] 0.65%, [P] 0.060%, [S] 0.022%, at a temperature of 1348° C. At the end of smelting, the tapped steel achieved [C] 0.16% and [P] 0.012%, the tapping temperature was 1629° C., and the tapping time was 5 min. 30 seconds after tapping started, 120 kg aluminum blocks were added separately. After adding the aluminum blocks, 3400 kg ferrosilicon, 660 kg silicomanganese, and 1756 kg high-carbon ferrochrome were added. Then, 800 kg recarburizer was added, followed by 550 kg lime and 310 kg slag-forming agent. After tapping was completed, slag blocking was performed using the slide gate and the slag stopper. The molten steel was then lifted to the LF for refining.

(2) LF Refining

A LF ladle sitting temperature was 1503° C. A sample was taken before refining started. Upon entering the LF station, 180 kg calcium carbide was used for deoxidation and desulfurization. After 15 minutes of refining, the silicon carbide was used for slag maintenance, i.e., the silicon carbide was added in small amounts and uniformly onto the slag surface to ensure the reducing atmosphere. According to the analysis results of the incoming sample, 692 kg ferrosilicon, 161 kg silicomanganese, 253 kg high-carbon ferrochrome, 100 kg ferrovanadium, and 300 kg nickel plate were added separately. The temperature was adjusted to 1571° C. Argon stirring intensity was maintained at 70 L/min throughout the refining process.

(3) RH Vacuum Treatment

After the molten steel arrived at the RH station, the ladle was raised to the vacuum tank. Cyclic vacuum pumping commenced. The lift gas was controlled at 100 $Nm^3/h$. After the vacuum degree reached 80 Pa, it was held for 20 min, then the vacuum was broken. 200 meters of the calcium wire was fed for the modification treatment. After soft blowing for 20 min, the molten steel was lifted to the continuous caster for casting.

(4) Bloom Continuous Casting

Before continuous casting started, the baking temperature of the tundish exceeded 1100° C. After casting starts, the surface of the molten steel in the tundish was entirely protected throughout casting using monolithic nozzles with a superheat control of 20-30° C. The temperature of the first heat was 1475° C. At the end of each heat casting, slag was retained in the ladle. The casting speed was controlled at 0.80 m/min. The primary cooling water return temperature difference was controlled at 5.55° C. The secondary cooling specific water volume was 0.20 L/kg. The mold electromagnetic stirring (M-EMS, operating at 300 A current and 2.0 Hz frequency) and the final electromagnetic stirring (F-EMS, operating at 300 A current and 6.0 Hz frequency) were implemented. The blooms were subjected to pit slow cooling with the entry temperature exceeding 500° C. and the holding time over 48 hours before removal from the pit.

(5) Roughing Production

The 300 mm×325 mm cast billets underwent prolonged high-temperature diffusion in the heating furnace with the total length of 51 m. The heating temperature was in a range of 1230~1250° C., allowing for extended high-temperature diffusion. After rolling through 10 stands, the billets were roughed into 160 mm×160 mm rolled billets. The collection temperature of the rolled billet was within a range of 450-460° C. After rolling, they were stacked for wind-sheltered cooling.

(6) Rolled Billet Finishing

The 160 mm×160 mm rolled billets underwent finishing peeling. The peeling depth per side was 2 mm. The surface inspection was then performed.

(7) Billet Heating

The 156 mm×156 mm rolled billets were heated in the high-speed wire rod heating furnace. The heating temperature was within a range of 1160-1190° C., with the heating time of 135 minutes. The rolling start temperature was within a range of 1060-1090° C.

(8) Wire Rod Rolling

The rolled billets were rolled into wire rods through roughing, intermediate rolling, pre-finishing, and finishing rolling, then entered the laying head. The finishing rolling temperature was within a range of 920-930° C. The temperature exiting the finishing mill was 1000° C.

(9) Wire Rod Controlled Cooling

The laying head temperature of the wire rod was 915° C., followed by controlled cooling including rapid cooling in the initial stage and hood cooling in the subsequent stage. The hood entry temperature was 565° C. The hood exit temperature was 480° C.

(10) The wire rods were coiled, bundled, packed, and warehoused.

(11) The wire rods underwent spheroidizing annealing and pickling-drawing in the finishing plant, and were reformed into the hexagonal wire bars. The annealing process was: 765° C. holding for 12 hours.

(12) After the wire rods were reformed into the hexagonal wire bars, they underwent machining. The manufactured screwdriver bits were subjected to the bainite isothermal quenching and the tempering treatment. The austenitizing temperature was 905° C., with the heating time of 82 minutes; the quenching temperature was 305° C., with the isothermal time of 60 minutes; the tempering temperature was 285° C., with the tempering time of 60 minutes. The average fatigue life test value for T25*57 mm screwdriver bits was 35,000 cycles. An average holding time in the impact resistance test was 72 seconds. The fracture location during torsion testing was at the head, with a flat fracture surface. Other test values are shown in Table 2.

A decarburization layer refers to a region on the steel surface where carbon elements react with the surrounding atmosphere and are lost during high-temperature heat treatment. Decarburization leads to reduced surface hardness and wear resistance, significantly negatively impacting the performance of the tool steel.

Figures 1, 2:
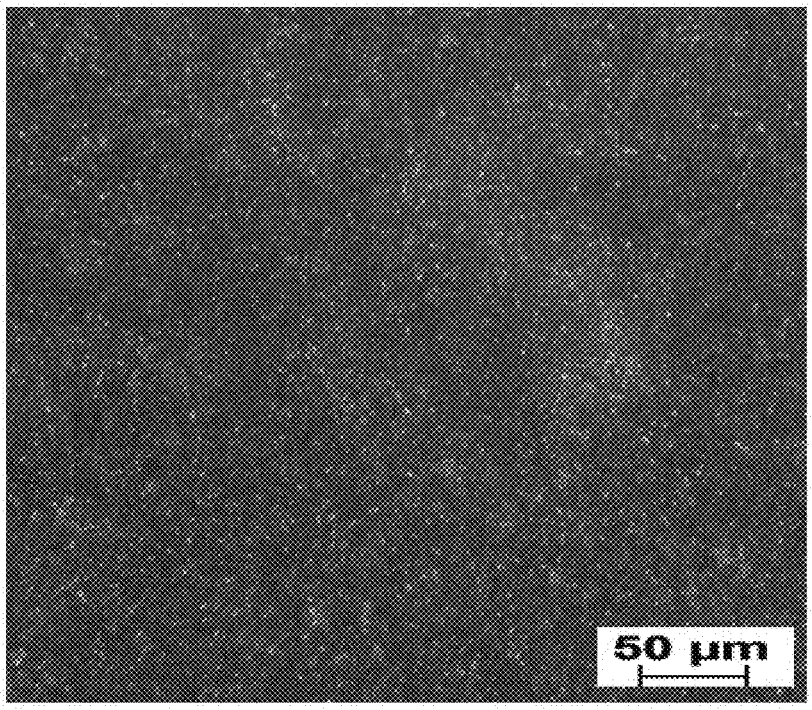
Figures 1, 2:
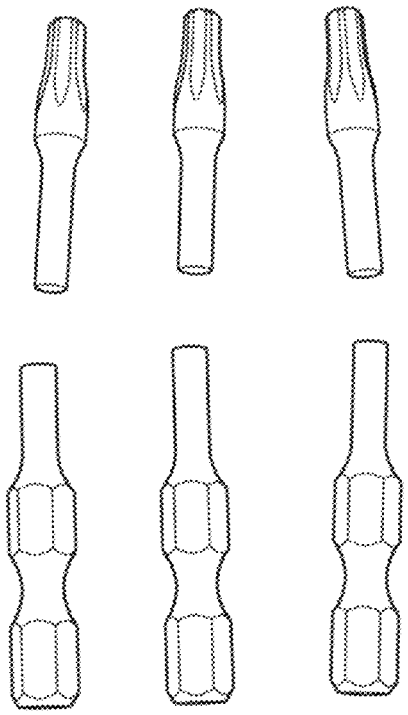
Figure 2:
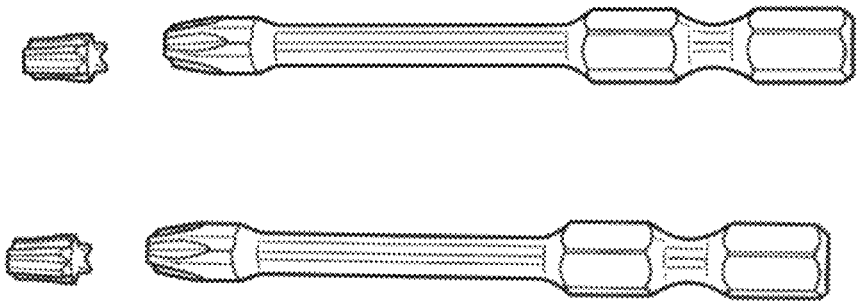

FIG. 1-1 is a decarburization layer diagram of a screwdriver bit in Example 1. FIG. 1-2 is a metallographic structure diagram of the screwdriver bit in Example 1. FIG. 1-1 shows the decarburization layer of the T25*57 mm screwdriver bit. The decarburization is 0 mm, indicating no loss of the carbon elements on the bit surface. The surface hardness and wear resistance are consistent with the bit interior. No performance weak zone was formed on the bit surface due to decarburization. Therefore, finished products like screwdriver bits manufactured from the steel wire rod of the present disclosure have better fatigue life. FIG. 1-2 shows the metallographic structure of the T25*57 mm screwdriver bit. Combining FIGS. 1-1 and 1-2, it is evident that the metallographic structure on the bit surface is essentially the same as that inside the bit. This indicates that the bainite isothermal quenching and the tempering treatment used in the present disclosure did not cause decarburization on the bit surface.

Example 2

The production process of the wire rod is the same as in Example 1, with slight adjustments to the composition within the preferred range of the present disclosure. The specific compositions are shown in Table 1. The wire rod process is the same as operations (1)-(12) of Example 1.

In fatigue life and impact resistance tests for the product of Example 2, a torsion fracture location was at the head, the fracture surface was flat, and the performance was normal, that is, the test value of average fatigue life for the T25*57 mm screwdriver bits was 33,000 times, the average holding time in the impact resistance test was 69 seconds. The torsion fracture location in the test was at the head, the fracture surface was flat, and other test values are shown in Table 2.

Example 3

The production process of the wire rod is the same as in Example 1, with slight adjustments to the composition within the preferred range of the present disclosure. The specific compositions are shown in Table 1. The wire rod process is the same as operations (1)-(12) of Example 1.

In the fatigue life and impact resistance tests for the product of Example 3, the torsion fracture location was at the head, the fracture surface was flat, and the performance was normal, that is, the test value of the average fatigue life for the T25*57 mm screwdriver bits was 38,000 times, the average holding time in the impact resistance test was 70 seconds. The torsion fracture location in the test was at the head, the fracture surface was flat, and other test values are shown in Table 2.

Example 4

The production process of the wire rod is the same as in Example 1, with slight adjustments to the composition within the preferred range of the present disclosure. The specific compositions are shown in Table 1. The wire rod process is the same as operations (1)-(12) of Example 1.

In the fatigue life and impact resistance tests for the product of Example 4, the torsion fracture location was at the head, the fracture surface was flat, and the performance was normal, that is, the test value of the average fatigue life for the T25*57 mm screwdriver bits was 41,000 times, the average holding time in the impact resistance test was 77 seconds. The torsion fracture location in the test was at the head, the fracture surface was flat, and other test values are shown in Table 2.

Comparative Example 1

The production process of the wire rod for Comparative Example 1 is the same as in Example 1, with the composition reduced to 0.80% carbon based on Example 1, and the rest unchanged. The specific compositions are shown in Table 1. The wire rod process is the same as operations (1)-(11) of Example 1 and the heat treatment parameters were fine-tuned based on the chemical compositions. The heat treatment temperatures are based on the Ac3 and Bs points of the steel grade. Ac3 refers to Austenite completion temperature 3. Bs refers to Bainite Start Temperature. When the composition difference in the comparative example is large, the Ac3 and Bs points change significantly, requiring adjustment of heat treatment parameters to ensure smooth production of the finished screwdriver bits. Using the same temperature as Example 1 would have adverse effects: insufficient austenitizing temperature, carbon and alloy not fully transforming into austenite, resulting in much lower hardness after quenching. The austenitizing temperature for the bainite isothermal quenching in Comparative Example 1 was 927° C., the quenching temperature was 330° C., and the tempering temperature was 285° C.

Due to the low carbon content and the high Ms temperature in Comparative Example 1, the hardness after the bainite isothermal quenching and the tempering slightly decreased. Test values for the fatigue life and the impact resistance showed some decline. In the impact resistance test, the torsion fracture location was at the head with a slanted fracture surface. Specific test values are shown in Table 2.

Comparative Example 2

The production process of the wire rod for Comparative Example 2 is the same as in Example 1, with the composition reduced to 2.05% silicon based on Example 1, and the rest unchanged. The specific compositions are shown in Table 1. The wire rod process is the same as operations (1)-(11) of Example 1. The heat treatment parameters were fine-tuned based on the chemical compositions. The austenitizing temperature for the bainite isothermal quenching was 887° C., the quenching temperature was 306° C., and the tempering temperature was 285° C.

Due to the low silicon content in Comparative Example 2, its effect on inhibiting the formation of cementite during cooling diminished. The hardness after the bainite isothermal quenching and the tempering slightly decreased. The test values for the fatigue life and the impact resistance showed some decline. In the impact resistance test, the torsion fracture location was at the head with a slanted fracture surface. The specific test values are shown in Table 2.

Comparative Example 3

The production process of the wire rod for Comparative Example 3 is the same as in Example 1, with the composition reduced to 1.10% nickel based on Example 1, and the rest unchanged. The specific compositions are shown in Table 1. The wire rod process is the same as operations (1)-(11) of Example 1. The heat treatment parameters were fine-tuned based on the chemical compositions. The austenitizing temperature for the bainite isothermal quenching was 905° C., the quenching temperature was 316° C., and the tempering temperature was 285° C.

Due to the low nickel content in Comparative Example 3, the impact test capability and the impact resistance showed a significant decline. In the impact resistance test, the torsion fracture location was at the head with a slanted fracture surface. The specific test values are shown in Table 2.

Comparative Example 4

The production process of the wire rod for Comparative Example 4 is the same as in Example 1, with the composition increased to 0.96% carbon based on Example 1, and the rest unchanged. The specific compositions are shown in Table 1. The wire rod process is the same as operations (1)-(11) of Example 1. The heat treatment parameters were fine-tuned based on the chemical compositions. The austenitizing temperature for the bainite isothermal quenching was 885° C., the quenching temperature was 287° C., and the tempering temperature was 290° C.

Due to the high carbon content and the low Bs temperature in Comparative Example 4, the hardness after the bainite isothermal quenching and tempering increased significantly, but the test values for the fatigue life and the impact resistance showed a large decline. In the impact resistance test, the torsion fracture location was at the shank with a slanted fracture surface. The specific test values are shown in Table 2.

Comparative Example 5

The production process of the wire rod for Comparative Example 5 is the same as in Example 1, with the composition increased to 2.72% silicon based on Example 1, and the rest unchanged. The specific compositions are shown in Table 1. The wire rod process is the same as operations (1)-(11) of Example 1. The heat treatment parameters were fine-tuned based on the chemical compositions. The austenitizing temperature for the bainite isothermal quenching was 920° C., the quenching temperature was 305° C., and the tempering temperature was 290° C.

Due to the high silicon content in Comparative Example 5, the hardness after spheroidizing annealing was high, which was unfavorable for drawing production. The hardness after the bainite isothermal quenching and tempering increased significantly, but the test values for the fatigue life and the impact resistance showed some decline. In the impact resistance test, the torsion fracture location was at the shank with a slanted fracture surface. The specific test values are shown in Table 2.

Comparative Example 6

The production process of the wire rod for Comparative Example 6 is the same as in Example 1, with the composition reduced to 0.40% chromium based on Example 1, and the rest unchanged. The specific compositions are shown in Table 1. The wire rod process is the same as operations (1)-(11) of Example 1; heat treatment parameters were fine-tuned based on the chemical compositions. The austenitizing temperature for the bainite isothermal quenching was 907° C., the quenching temperature was 337° C., and the tempering temperature was 285° C.

The hardness after the bainite isothermal quenching and tempering in Comparative Example 6 increased significantly, but the test values for the fatigue life and the impact resistance showed some decline. In the impact resistance test, the torsion fracture location was at the head with a slanted fracture surface. The specific test values are shown in Table 2.

Comparative Example 7

The production process of the wire rod is the same as in Example 1, but a traditional S2M material was used for comparative testing. A chromium content and a nickel content of the S2M material is lower than that of the steel wire rod of the present disclosure, and the S2M material additionally contains molybdenum. The wire rod process is the same as operations (1)-(10) of Example 1. The annealing process for the wire rod was 750° C.*10H. The austenitizing temperature for the bainite isothermal quenching was 865° C., the quenching temperature was 385° C., and the tempering temperature was 230° C. Due to the low carbon content and very high Bs temperature, the average hardness after the bainite isothermal quenching and tempering was only 59.1 HRC. The fatigue life and the impact resistance performance showed a large gap compared to the examples. However, in the impact resistance test, the torsion fracture surface was flat, indicating a ductile fracture.

The chemical compositions of the examples and comparative examples in the present disclosure are shown in Table 1. Table 2 lists various performance test data using the finished screwdriver bits T25*57 mm as an example, including hardness, torque, maximum torsion angle, 13.3 N·M static torque fatigue life and impact resistance test data, and the torsion fracture location and appearance. Specific torsion fracture locations and appearances can be seen in FIG. 2. FIG. 2-1 a schematic diagram illustrating an appearance of a shank of a T25*57 mm finished screwdriver bit fractured in an impact resistance test (abbreviated as "shank fracture" in the table). FIG. 2-2 a schematic diagram illustrating an appearance of a head of a T25*57 mm finished screwdriver bit fractured in an impact resistance test (abbreviated as "head fracture" in the table). Flat fracture in the table indicates that the torsion fracture surface is flat.

TABLE 1

Chemical compositions of examples and comparative examples (%)

| | C | Si | Mn | P | S | Cr | Ni | V | Al | Mo |
|---|---|---|---|---|---|---|---|---|---|---|
| Example 1 | 0.88 | 2.33 | 0.5 | 0.012 | 0.007 | 0.8 | 1.33 | 0.19 | 0.042 | 0 |
| Example 2 | 0.89 | 2.35 | 0.49 | 0.008 | 0.005 | 0.81 | 1.33 | 0.22 | 0.032 | 0 |
| Example 3 | 0.89 | 2.35 | 0.51 | 0.009 | 0.008 | 0.79 | 1.32 | 0.19 | 0.039 | 0 |
| Example 4 | 0.88 | 2.38 | 0.49 | 0.011 | 0.006 | 0.83 | 1.33 | 0.2 | 0.041 | 0 |
| Comparative Example 1 | 0.80 | 2.33 | 0.45 | 0.012 | 0.008 | 0.85 | 1.33 | 0.2 | 0.043 | 0 |
| Comparative Example 2 | 0.89 | 2.05 | 0.49 | 0.013 | 0.009 | 0.8 | 1.33 | 0.19 | 0.032 | 0 |
| Comparative Example 3 | 0.87 | 2.34 | 0.48 | 0.011 | 0.007 | 0.81 | 1.10 | 0.18 | 0.021 | 0 |
| Comparative Example 4 | 0.96 | 2.33 | 0.49 | 0.009 | 0.009 | 0.8 | 1.34 | 0.21 | 0.035 | 0 |
| Comparative Example 5 | 0.89 | 2.72 | 0.5 | 0.01 | 0.008 | 0.81 | 1.33 | 0.2 | 0.038 | 0 |
| Comparative Example 6 | 0.88 | 2.35 | 0.49 | 0.011 | 0.007 | 0.4 | 1.34 | 0.21 | 0.035 | 0 |
| Comparative Example 7 | 0.7 | 1.01 | 0.44 | 0.014 | 0.005 | 0.2 | 0.14 | 0.17 | 0.032 | 0.42 |

TABLE 2

Performance test data of tools using T25 * 57 mm finished screwdriver bits as an example

| | Hardness (HRC) | Torque (kgf·cm) | Maximum torsion angle (°) | T25 * 57mm fatigue life test ($\times 10^4$ cycles) | T25 * 57mm impact resistance test | |
|---|---|---|---|---|---|---|
| | | | | | Time(s) | Fracture location and appearance |
| Example 1 | 61.0 | 258 | 220 | 3.5 | 72 | Head fracture + flat fracture |
| Example 2 | 61.1 | 260 | 214 | 3.3 | 69 | Head fracture + flat fracture |
| Example 3 | 61.2 | 260 | 215 | 3.8 | 70 | Head fracture + flat fracture |
| Example 4 | 61.1 | 259 | 228 | 4.1 | 77 | Head fracture + flat fracture |
| Comparative Example 1 | 60.1 | 245 | 152 | 1.3 | 44 | Head fracture + flat fracture |
| Comparative Example 2 | 60.3 | 244 | 154 | 1.1 | 45 | Head fracture + flat fracture |
| Comparative Example 3 | 59.7 | 239 | 126 | 0.7 | 39 | Head fracture + flat fracture |
| Comparative Example 4 | 62.8 | 259 | 110 | 0.3 | 25 | Shank fracture + flat fracture |
| Comparative Example 5 | 62.2 | 268 | 102 | 0.3 | 22 | Shank fracture + flat fracture |
| Comparative Example 6 | 60.0 | 238 | 148 | 0.6 | 36 | Head fracture + flat fracture |
| Comparative Example 7 | 59.1 | 238 | 158 | 0.4 | 21 | Head fracture + flat fracture |

Figure 3:
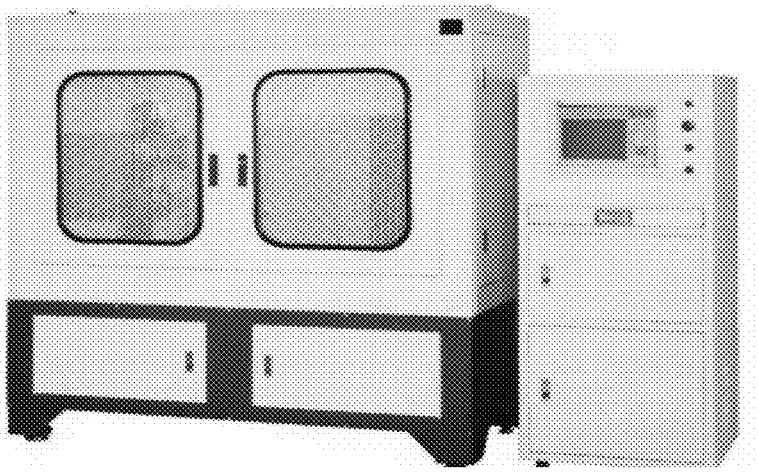
FIG. 3 shows a full-function torque life tester and its model number for a T25*57 mm finished screwdriver bit.

Notes (1) FIG. 3 shows a full-function torque life tester and its model number for a T25*57 mm finished screwdriver bit. The fatigue life test, the torque, and the maximum torsion angle were tested on the PB-6010 full-function torque life tester (referring to FIG. 3). The fatigue life test was conducted under a set torque condition (13.3 N·M) using forward and reverse rotation until the finished screwdriver bit fractured. The torque and maximum torsion angle were tested using unidirectional torsion until fracture occurred, and the data output by the machine was recorded.

Figure 4:
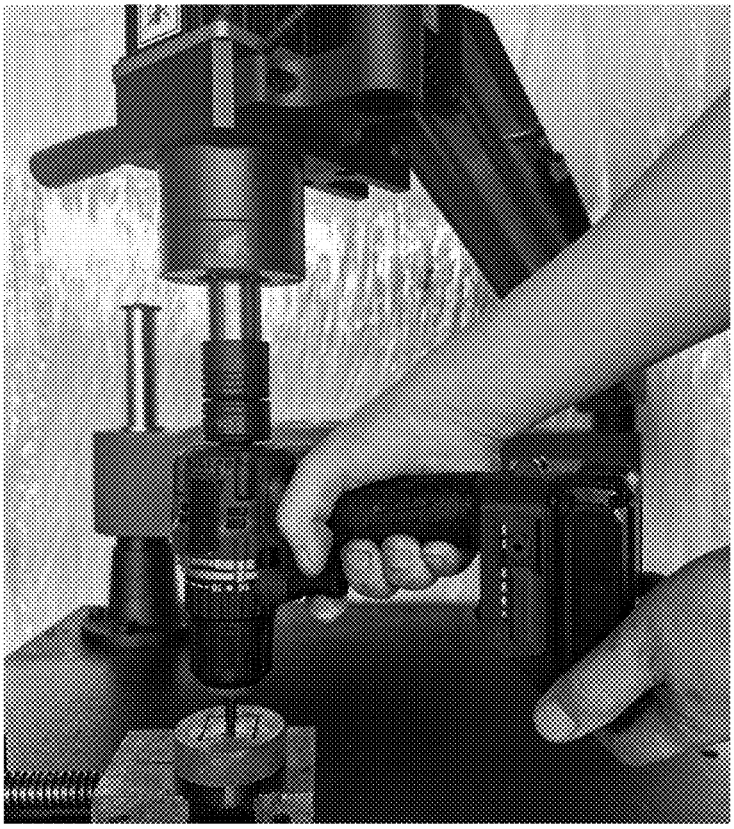
FIG. 4 shows impact resistance testing equipment for a T25*57 mm finished screwdriver bit.

(2) FIG. 4 shows impact resistance testing equipment for a T25*57 mm finished screwdriver bit. The impact resistance test operation is shown in FIG. 4. The specific operation includes that: the screw is fixed, a power tool equipped with the finished screwdriver bits is clamped, the power is turned on to start driving the screw at the maximum torque (205 N·M). The finished screwdriver bit is continuously subjected to shear stress until fractured. The parameter for evaluation is a duration from when the finished screwdriver bits start being stressed until fracture occurs, with a longer duration being better.

(3) Hardness test: Conducted according to GB/T 230.1-2018 (Metallic materials—Rockwell hardness test—Part 1: Test manner).

FIG. 1 shows the microstructure and decarburization layer of Example 1. FIG. 2 shows the fracture location and appearance of T25*57 mm finished screwdriver bits after the impact resistance test. FIG. 2-1 shows the flat fracture at the head of the T25*57 mm screwdriver bits. FIG. 2-2 shows the flat fracture at the shank of the T25*57 mm screwdriver bits.

The tools made from the alloy tools steel wire rod with the high fatigue life and the high impact resistance described in the present disclosure exhibit significant advantages in performance such as hardness, fatigue life, and resistance to torsion impact, which may be effectively applied in the field of hardware tools such as screwdriver bits, screwdrivers, hex wrenches, etc., enhancing the technical level of the hardware tools industry and holding considerable practical significance.

Unless otherwise specified, the raw materials and equipment used in the present disclosure are common in the field; unless otherwise specified, the methods used in the present disclosure are conventional methods in the field. The above description presents only the preferred embodiments of the present disclosure and is not intended to limit it. Any modifications made to the above examples based on the technical essence of the present disclosure shall fall within the scope of protection of the present disclosure.

What is claimed is:

1. A method for producing alloy tools, comprising:

providing a steel wire rod, wherein chemical compositions of the steel wire rod comprise, by weight percentage:

[C] 0.88%-0.92%, [Si] 2.31%-2.60%, [Mn] 0.40%-0.80%, [Cr] 0.70%-1.05%, [Ni] 1.31%-1.61%, [V] 0.14%-0.30%, [Al] 0.025%-0.060%, [P]≤0.025%, [S]≤0.020%, with the rest being Fe and unavoidable impurities, and the chemical compositions of the steel wire rod does not comprise [Mo] element; a fatigue life of the steel wire rod is not less than 30,000 cycles and an impact resistance of the steel wire rod is not less than 60 seconds;

producing the alloy tools by using the steel wire rod, comprising:

obtaining the alloy tools by subjecting the steel wire rod to bainite isothermal quenching and tempering treatment, wherein an austenitizing temperature is 905° C., a salt bath quenching temperature is 305° C., and a tempering temperature is 285° C.; and the providing a steel wire rod comprising:

trimming and heating rolled billet, wherein heating temperature is within a range of 1160° C.-1190° C.;

producing a wire rod by roughing rolling, intermediate rolling, pre-finishing rolling, and finishing rolling the rolled billet, wherein a finishing rolling temperature of the finishing rolling is within a range of 910° C.-950° C., and an exit temperature of a finishing mill used for the finishing rolling is not less than 970° C.; and producing the steel wire rod by cooling the wire rod, comprising:

spheroidizing annealing the steel wire rod, wherein an annealing temperature is 765° C. and an annealing time is 12 hours.

2. The method of claim 1, wherein the chemical compositions of the steel wire rod comprise, by weight percentage:

[C] 0.88%-0.90%, [Si] 2.31%-2.45%, [Mn] 0.40%-0.60%, [Cr] 0.75%-0.95%, [Ni] 1.31%-1.41%, [V] 0.18%-0.24%, [Al] 0.025%-0.050%, [P]≤0.025%, [S]≤0.015%, with the rest being Fe and unavoidable impurities.

* * * * *